US012098013B2

(12) United States Patent
Bertschi

(10) Patent No.: US 12,098,013 B2
(45) **Date of Patent: *Sep. 24, 2024**

(54) MULTILAYER COVER OF A VACUUM DRAWER DEVICE

(71) Applicant: Julius Blum GmbH, Hoechst (AT)

(72) Inventor: Daniel Bertschi, Gelfingen (CH)

(73) Assignee: JULIUS BLUM GMBH, Hoechst (AT)

( * ) Notice: Subject to any disclaimer, the term of this patent is extended or adjusted under 35 U.S.C. 154(b) by 198 days.

This patent is subject to a terminal disclaimer.

(21) Appl. No.: 17/835,536

(22) Filed: Jun. 8, 2022

(65) Prior Publication Data

US 2022/0357092 A1 Nov. 10, 2022

Related U.S. Application Data

(63) Continuation of application No. PCT/EP2020/084945, filed on Dec. 7, 2020.

(30) Foreign Application Priority Data

Dec. 9, 2019 (CH) ..... 01569/19

(51) Int. Cl.
*B65D 81/20* (2006.01)
*A47B 77/16* (2006.01)
*A47B 88/919* (2017.01)

(52) U.S. Cl.
CPC ..... *B65D 81/2007* (2013.01); *A47B 77/16* (2013.01); *A47B 88/919* (2017.01); *A47B 2210/08* (2013.01)

(58) Field of Classification Search
CPC . B65D 81/2007; A47B 2210/08; A47B 77/16; A47B 2088/976; A47B 2088/205;
(Continued)

(56) References Cited

U.S. PATENT DOCUMENTS 5,806,575 A * 9/1998 Tsay ..... B65D 81/2015 141/192
6,837,068 B2 * 1/2005 Wood ..... F25D 17/045 62/412

(Continued)

FOREIGN PATENT DOCUMENTS

CH 713233 A2 * 6/2018 ..... A47B 77/16
CH 713594 A2 * 9/2018

(Continued)

OTHER PUBLICATIONS

International Search Report issued Mar. 12, 2021 in International (PCT) Application No. PCT/EP2020/084945.

*Primary Examiner* — Andrew Roersma
(74) *Attorney, Agent, or Firm* — Wenderoth, Lind & Ponack, L.L.P.

(57) ABSTRACT

A multilayer cover has a sandwich design for placement on a drawer of a vacuum drawer device, and the cover allows an evacuation of the drawer interior after sealing against the drawer. The cover has an outer air-tight cover layer and a core layer, recesses molded into the core layer and partly into one of the at least one outer cover layer, and an evacuation channel, a pump, and at least one sensor are arranged therein. The cover is to have a more compact design with a very low height, resulting in a minimal susceptibility to malfunction. This is achieved in that a printed circuit board is arranged on one of the at least one outer air-tight cover layers so as to face the core layer or the at least one outer air-tight cover layer is designed as a printed circuit board on which the core layer lies and on which the electric components integrated into the cover are mechanically held and are electrically connected.

18 Claims, 6 Drawing Sheets

(58) Field of Classification Search
CPC ..... A47B 2088/0011; A47B 88/919; A47B 88/969; A47B 88/994; F25D 2317/043; F25D 17/042
See application file for complete search history.

(56) References Cited

U.S. PATENT DOCUMENTS

| | | | | |
|---|---|---|---|---|
| 7,891,205 | B2 | 2/2011 | Cushman | |
| 9,586,745 | B1 * | 3/2017 | Givler | B32B 27/32 |
| 11,805,900 | B2 * | 11/2023 | Bertschi | A47B 88/457 |
| 2002/0025254 | A1 * | 2/2002 | Chen | F04B 49/022 417/44.2 |
| 2007/0271945 | A1 * | 11/2007 | Jung | F25D 27/00 62/344 |
| 2007/0272325 | A1 * | 11/2007 | Tsay | B01J 3/03 141/65 |
| 2008/0131567 | A1 * | 6/2008 | Lemme | F04B 35/04 426/418 |
| 2008/0282714 | A1 | 11/2008 | Cushman | |
| 2010/0319374 | A1 * | 12/2010 | Ihle | F25D 25/025 62/176.1 |
| 2015/0037477 | A1 * | 2/2015 | Espinosa | A47F 7/0071 426/418 |
| 2020/0156848 | A1 * | 5/2020 | Zhou | B65D 81/2038 |
| 2021/0123667 | A1 | 4/2021 | Bertschi | |
| 2022/0299260 | A1 * | 9/2022 | Bertschi | F25D 25/025 |
| 2022/0369811 | A1 * | 11/2022 | Bertschi | A47B 88/919 |

FOREIGN PATENT DOCUMENTS

| | | | | |
|---|---|---|---|---|
| CH | 713601 | A2 * | 9/2018 | A47B 77/18 |
| CN | 204787589 | | 11/2015 | |
| CN | 105540028 | A * | 5/2016 | |
| CN | 106918191 | | 7/2017 | |
| CN | 106275704 | | 9/2018 | |
| CN | 208875624 | | 5/2019 | |
| DE | 102011080124 | A1 * | 1/2013 | B01D 46/0023 |
| DE | 20 2017 006 169 | | 2/2018 | |
| DE | 202017006169 | U1 * | 2/2018 | |
| JP | 2009-537792 | | 10/2009 | |
| KR | 1020170022619 | A * | 3/2017 | F25D 17/06 |
| WO | 2005/047112 | | 5/2005 | |
| WO | 2007/010267 | | 1/2007 | |
| WO | 2018/161918 | | 9/2018 | |
| WO | 2019/141574 | | 7/2019 | |
| WO | WO-2019141574 | A1 * | 7/2019 | A23L 3/3418 |

* cited by examiner

MULTILAYER COVER OF A VACUUM DRAWER DEVICE

BACKGROUND OF THE INVENTION

The present invention describes a multilayer lid of sandwich (layered) construction for placing on a drawer of a vacuum drawer system, which lid enables evacuation of a drawer interior after sealing towards the drawer. The lid comprises at least one outer airtight top layer and a core layer, in which recesses are formed in the core layer and partially in one of the at least one outer top layer, in which recesses an evacuation duct, a pump and at least one sensor are arranged.

Refrigerators for food storage have some disadvantages, since a lot of electrical energy is needed to constantly cool an interior room on a massive scale. Little attention has been paid to the indoor climate of the refrigerator. According to a study by the Hygiene Council, which has carried out an international study called Hygiene Report 2010, the refrigerator with about 11400000 germs per square centimeter is also more contaminated than a toilet with about 100 pathogens per square centimeter. This 2010 news received a lot of media attention. However, apart from recommendations to clean the refrigerator more often, no noticeable improvements have taken place so far.

A vacuum drawer system with a drawer and a lid was generally disclosed for the first time in DE202017006169, in which a negative pressure could be generated in a drawer interior by means of a pump. The vacuum drawer system comprises a drawer having walls and a drawer interior. The drawer can be operatively connected with a lid and is linearly movably supported within a drawer body. However, more precise details about the drawer, the lid, possibly lifting means and evacuation means are largely left open in DE202017006169.

The closest prior art is WO2019/141574 of the applicant. Food that does not necessarily need cooling can be stored in a vacuum drawer system at room temperature, in which an increased energy consumption for cooling is not required. The drawer interior is evacuated to a slight negative pressure, which is generated and maintained in a controlled manner. Food can thus be kept consumable or edible for longer in a simplified manner. Storage in the drawer body with vacuum drawer system requires less energy than the refrigerator, since the oxygen removal in the interior is completed after a few minutes and almost no further electricity is needed afterwards. A vacuum drawer system can be realized without harmful materials such as refrigerant or thermal insulation. The consumption of plastic bags in known vacuuming by means of vacuuming devices can be significantly reduced, and yet food can be stored for longer periods without any problems. Using vacuum drawer systems, food can be stored in a simpler, more environmentally friendly and energy-efficient way. This has a positive effect on the quality of food and the health of consumers. Less food would also be thrown away and the often criticized "food waste", i.e. food squandering, would be limited, as the quality of the food can be preserved for longer.

The drawer body forms the outer shell in which the lid and the drawer are movably-supported in a protected manner. Lifting means and evacuation means, which are operable electrically via a controller, are arranged in the lid or the drawer so that evacuation is made possible in a controlled way when the lid is placed on the drawer. Air is pumpable out from the drawer interior through an air duct. If sensors are arranged, the evacuation can happen in an automated way and also ventilation before opening the drawer can be detected and automatically initiated by the controller.

In WO2019/141574, a multi-layered lid is provided, which is as compact as possible and can also be easily mounted on existing drawers. To keep the constructional height of the lid small, the lifting and evacuation means are preferably integrated in the lid. In practice, however, the lid is still relatively heavy and bulky, and constant actuation of the lid, i.e. lifting movements in the opposite direction, can lead to malfunctions in operation.

SUMMARY OF THE INVENTION

The present invention has the object of creating a lid of a vacuum drawer system and a vacuum drawer system comprising a drawer, lifting means, evacuation means and such a lid, and the lid is designed more compact with minimal constructional height and reduced susceptibility to faults. A maintenance-free and permanently fault-free operation is to be achieved with the lid for automated closing of the drawer.

Such a lid in sandwich (layered) construction leads to a permanent fault-free and safe operation, so that the overall robustness of the lid or the vacuum drawer system can be significantly increased.

BRIEF DESCRIPTION OF THE DRAWINGS

Preferred embodiments of the object of the invention are described below in connection with the accompanying drawings.

FIG. 1 is a perspective view of a vacuum drawer system in a drawer body with the drawer open, while FIG. 3 is a top view of a lid, when arranged on the drawer, while

FIG. 5 is a view of the cover from an opposite side of the printed circuit board and thus the bottom side of the printed circuit board, in which sealing means are applied, while

DETAILED DESCRIPTION OF THE INVENTION

Figure 1:
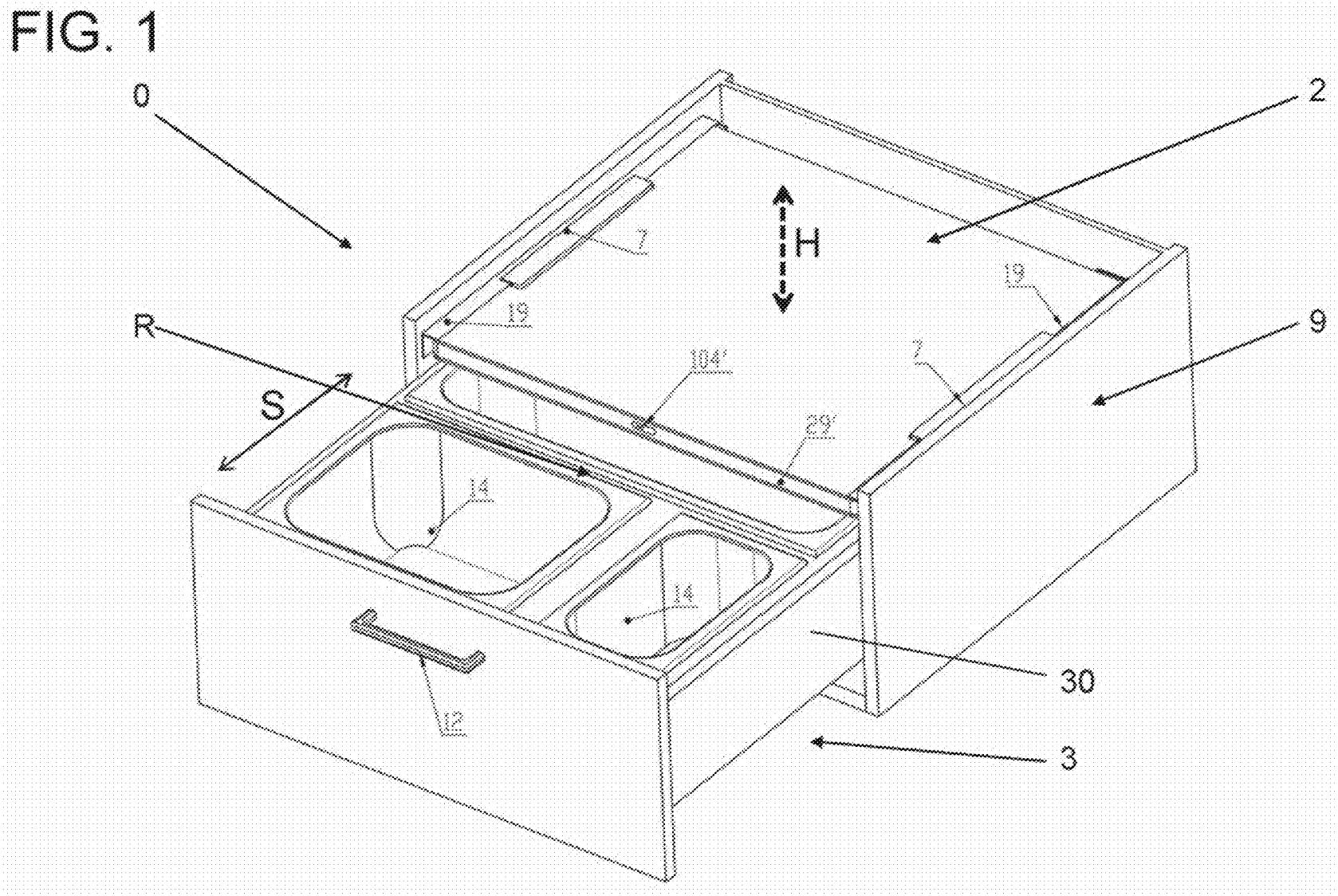

The vacuum drawer system 0 is herein altogether referred to as 0 and comprises a drawer 3, with a drawer interior R and a lid 2 relatively movable by a lifting device 7 in a lifting direction H. The drawer 3 can be operatively connected to the lid 2 and is linearly movably supported within a drawer body 9 in a direction of sliding movement S. The drawer body 9 forms the outer shell in which the lid 2 and the drawer 3 are movably supported in a protected manner. The drawer 3 comprises walls 30 and the drawer interior R, and can be movably supported between an open position and a closed position in the direction of the sliding movement S, and is configured to be evacuated. The drawer 3 is linearly supported in a movable manner in a drawer pullout guide, which is not explained in more detail, so that the drawer 3 can be brought into an open position and a closed position. In FIG. 1, the open position of the drawer 3 is shown.

The evacuable drawer interior R is formed by a plurality of containers 14. The containers 14 are positionally arranged within the drawer 3 and have an identical height, though of different sizes. Preferably, the containers 14 are in the form of gastro standard containers, the interiors of which can form the entire drawer interior R, which can be closed and evacuated by the lid 2. The containers 14 are supported in the drawer 3 and are movable together with the drawer 3, but can also be removed.

For evacuating the drawer interior R, the lid 2 serves as a movable lid inside the drawer body 9, which is designed airtight and is placed so that it can be lowered onto the drawer 3 in a lifting direction H extending vertically to the direction of the sliding movement S. The lid 2 is fastened here to the drawer body 9 with mounting brackets 19, so that a relative movement of the lid 2 to the drawer 3 is possible. The lifting device 7 is arranged on or in the lid 2 within the drawer body 9, the lifting device 7 movably holding the lid 2 within the drawer body 9 in the lifting direction H. The lifting device 7 can be designed in different ways, which are not further discussed here.

With a lid side facing the drawer 3, the lid 2 can be placed on edges of the containers 14, whereby the at least one drawer interior R can be closed. The lid 2 is movably supported relative to the drawer body 9 and relative to the drawer 3. Closing only takes place when the drawer 3 is in the closed position. When the drawer 3 is in the open position, as shown in FIG. 1, the lid 2 releases the drawer 3 completely. The drawer 3 can be gripped at a handle 12 and moved in the direction of sliding movement S. With an operating button 104' on the lid 2, the vacuum drawer system 0 can be activated and deactivated. At least one closed position sensor 29' can be arranged on the lid 2, which signals to a controller of the lid 2 that the lid 2 is closed.

With the lifting device 7, the lid 2 can be lifted in a controlled manner in the opposite direction from the drawer 3 or the containers 14, and is arranged to be lowered onto them. This produces the lifting movement of the lid 2 in the lifting direction H vertical to the direction of the sliding movement S of the drawer 3. The containers 14 inside the drawer 3 of the vacuum drawer system 0 can be closed off towards the top as a whole compared to conventional drawers by the consumer manually closing the drawer 3, and the lid 2 lowers itself onto the containers 14 in the closed position of the drawer 3, and closes them off in an airtight manner from the top.

Figure 2:
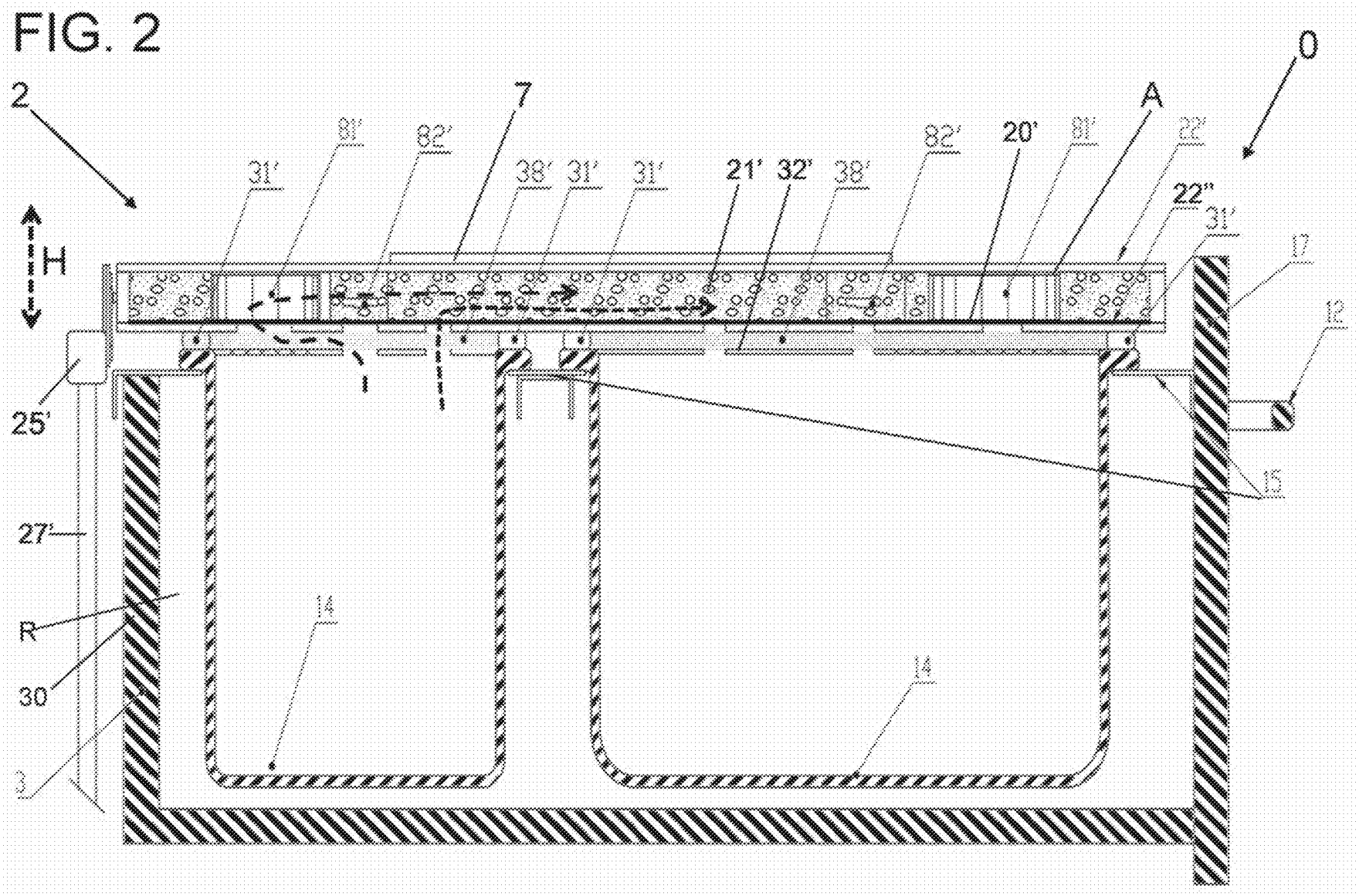
FIG. 2 is a schematic partial section through a vacuum drawer system of FIG. 1 in a drawer body with the drawer or vacuum drawer system closed.
Figure 3:
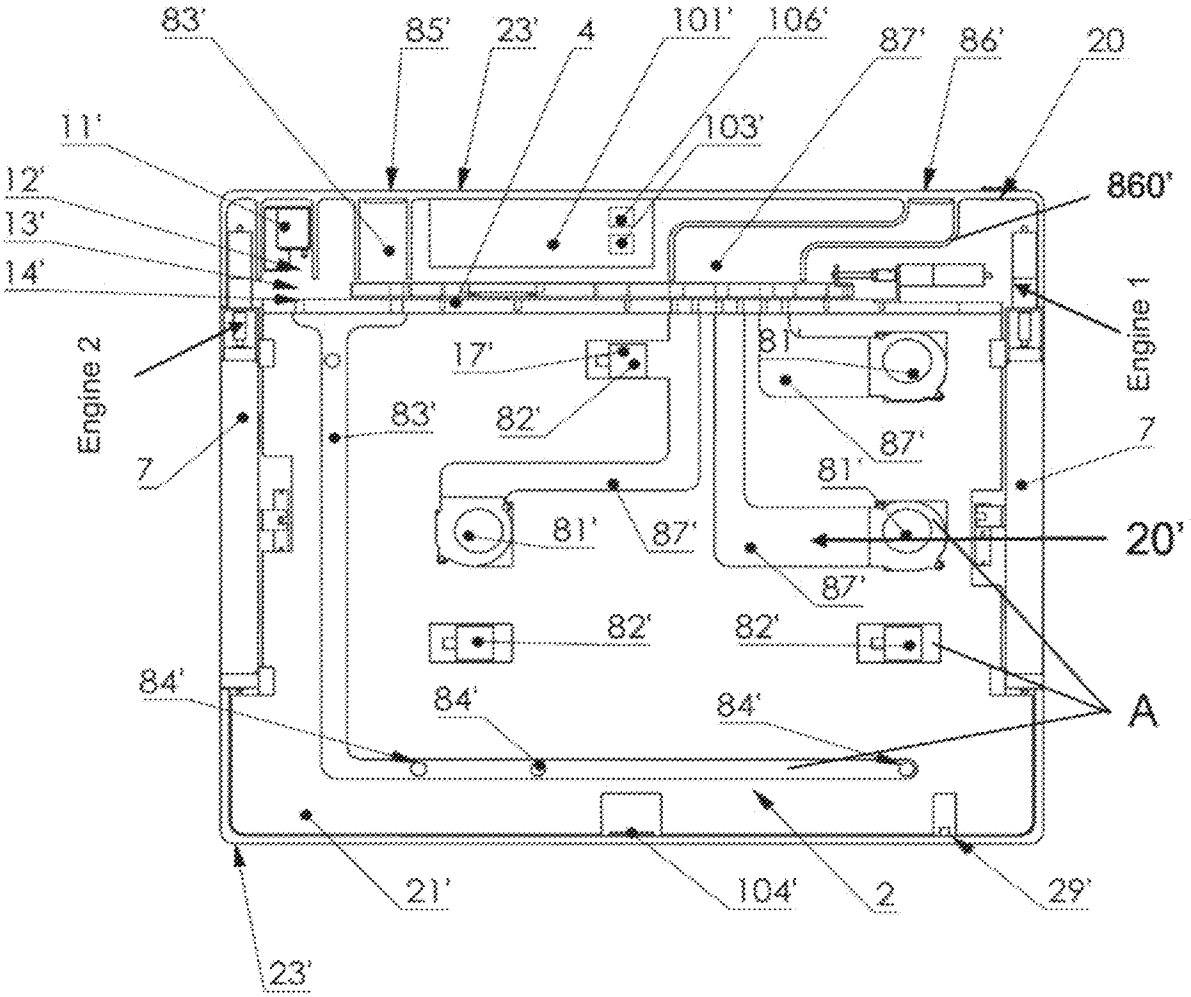

FIG. 2 shows the airtightly designed and multilayered lid 2 lying on the drawer 3 or sealing fittings 15. The surrounding drawer body 9 is omitted for simplicity and the drawer 3 with a front panel 17 and a handle 12 is shown in a cross-sectional view. The lid 2 rests on the container interior R and on the containers 14 in an airtight manner for closing off.

In order to achieve a compact design of the lid 2, as many electronic components as possible are integrated into the multilayer lid 2. For instance, at least one evacuation duct, several sensors 82', at least one valve, at least one motor, as well as at least one ventilator 81' and one air duct should be arranged within the lid 2 in recesses A. Through the at least one evacuation duct, an automated evacuation by means of a pump, and through the at least one air duct, an automated air exchange by means of a ventilator 81' of the drawer interior R or the interiors of the containers 14 can take place. The different paths of the air when evacuating and exchanging air are indicated with dashed lines.

A power cable 27' is arranged running to a connector plug 25', by means of which the controller is operated, which controls the lifting means, the evacuation means, the air exchange means and the sensors. The controller is also arranged here in a recess A in the lid 2, but could also be arranged within the drawer body 9 separately from the lid 2.

The lid 2 has a sandwich (i.e., layered) construction, in which different materials are assembled in different layers to form a lid 2. The lid 2 has two outer airtight top layers 22', 22" and a core layer 21'. An additional printed circuit board 20' is arranged here, which, however, can also be used instead of one of the outer airtight top layers 22', 22".

The layers 20', 21', 22', 22" are glued together in a statically effective manner to form a multi-layer lid 2, which is designed to be correspondingly torsion-resistant. The upper top layer 22' is designed to be airtight and can be made of MDF, CFK or glass. However, an air-impermeable plastic coating can also be arranged on an air-permeable material as an upper top layer 22' in order to achieve the air-tightness of the upper top layer 22'.

Recesses A are provided in the core layer 21', in which the electrical devices, such as evacuation means, in particular the pump, air exchange means, in particular at least one ventilator 81' and sensors, in particular at least one humidity sensor 82' are arranged. Motors or other components of the lifting means can also be partially fitted in the recesses A.

Not shown are at least one air duct, which is necessary for the exhaust air of the ventilator 81', and at least one evacuation duct, which co-operates with the pump and is necessary for the generation of a negative pressure or vacuum inside the drawer interior R. All electrical components are mechanically fixed and electrically connected to each other and to the controller by means of printed circuit board 20'.

In order to achieve a lid 2 as compact as possible, as many components as possible should be placed within the lid 2, so that such a lid 2 can also be easily combined with existing drawers 3, whereby vacuum drawer systems 0 can be manufactured from an existing drawer body 9, a drawer 3 and a lid 2.

The core layer 21' can be made of a rigid plastic foam or a honeycomb-like plastic structure or a solid plastic layer, and the necessary recesses A must be arranged. The evacuation ducts and/or air ducts can be recessed from the material of the core layer 21'.

Conductor tracks are arranged on at least one side of the printed circuit board 20', to which the electrical consumers are connected. Contacting the electrical components or the components to be controlled by the controller, and the controller on the printed circuit board 20' is simple and straightforward. The printed circuit board 20' is part of the layered-type lid 2 and is preferably oriented in such a way that the conductor tracks face towards the direction of the drawer interior R. There is no disturbing cabling inside the lid 2 which continues outside the lid 2 in the drawer body 9. Manufacturing the lid 2 is simplified and the susceptibility to faults during the lifting movement of the lid 2 is minimized.

To further increase the stability properties of the lid 2, a lower top layer 22", with the same properties as the upper top layer 22', can be used as part of the sandwich (layered) structure. This lower top layer 22" is attached to the printed circuit board 20' on the drawer interior side. To allow air to flow through the multi-layer lid 2, through-holes must be arranged in the printed circuit board 20' and the optional lower top layer 22" so that the drawer interior R or the interior of the containers 14 is capable of being pumped out.

To increase the evacuation properties of the lid 2, a layer of seal profiles 31' is arranged on the drawer interior side, which improves sealing against the edges of the containers 14 or the sealing fittings 15. For hygienic reasons, the seal profiles 31' are detachably secured, and are thus designed to be removable for cleaning purposes.

In a further embodiment with or without a lower top layer 22' and/or seal profiles 31', a seal holder 32' and a layer of air filter fleece 38' may be attached to the drawer-side surface of the lid 2.

In the top view onto the lid 2 with the upper top layer 22' removed, a lid frame 23' can be seen in which the individual layers of the sandwich structure are held. The core layer 21' can be seen here, which has recesses A. Evacuation ducts 83', holes 84' to the drawer interior R, humidity sensors 82', at least one pressure sensor 17', ventilators 81', evacuation ducts 83' and parts of the lifting means 7 in the form of motors are arranged on or in the core layer 21'. The components project at least partially into the recesses A.

On the side of the core layer 21' opposite the later front panel 17 or the operating button 104', at least one valve 4 and, as indicated, a pump 11', an air hose 12' to the pump 11', a check valve 13' and a connector 14' of the pump 11" to the evacuation duct 83' are arranged. In the rear section of the lid 2, opposite the front panel 17, an air outlet opening 85', a control board 101', an acceleration sensor 103' and a bluetooth module 106', i.e. a wireless transmission unit according to the bluetooth standard, are arranged, Thereby, other wireless transmission protocols would be imaginable to program the controller or the control board 101' of the vacuum drawer system 0.

In order to achieve dehumidification of the drawer interior in addition to evacuation, ventilators 81' and the humidity sensors 82' are attached to the printed circuit board 20'. Air is sucked in from outside through an air inlet opening 86' and is introduced into the drawer interior R or the containers 14, and later pumped out again through dehumidification ducts 87' through an air outlet opening 85'. The ducts 87' and openings 85', 86', as well as the positions of the ventilators 81' and sensors 82' are recessed from the core layer 21'. Preferably, side walls are arranged along the dehumidification ducts 87' and the openings 85', 86'.

Figure 4:
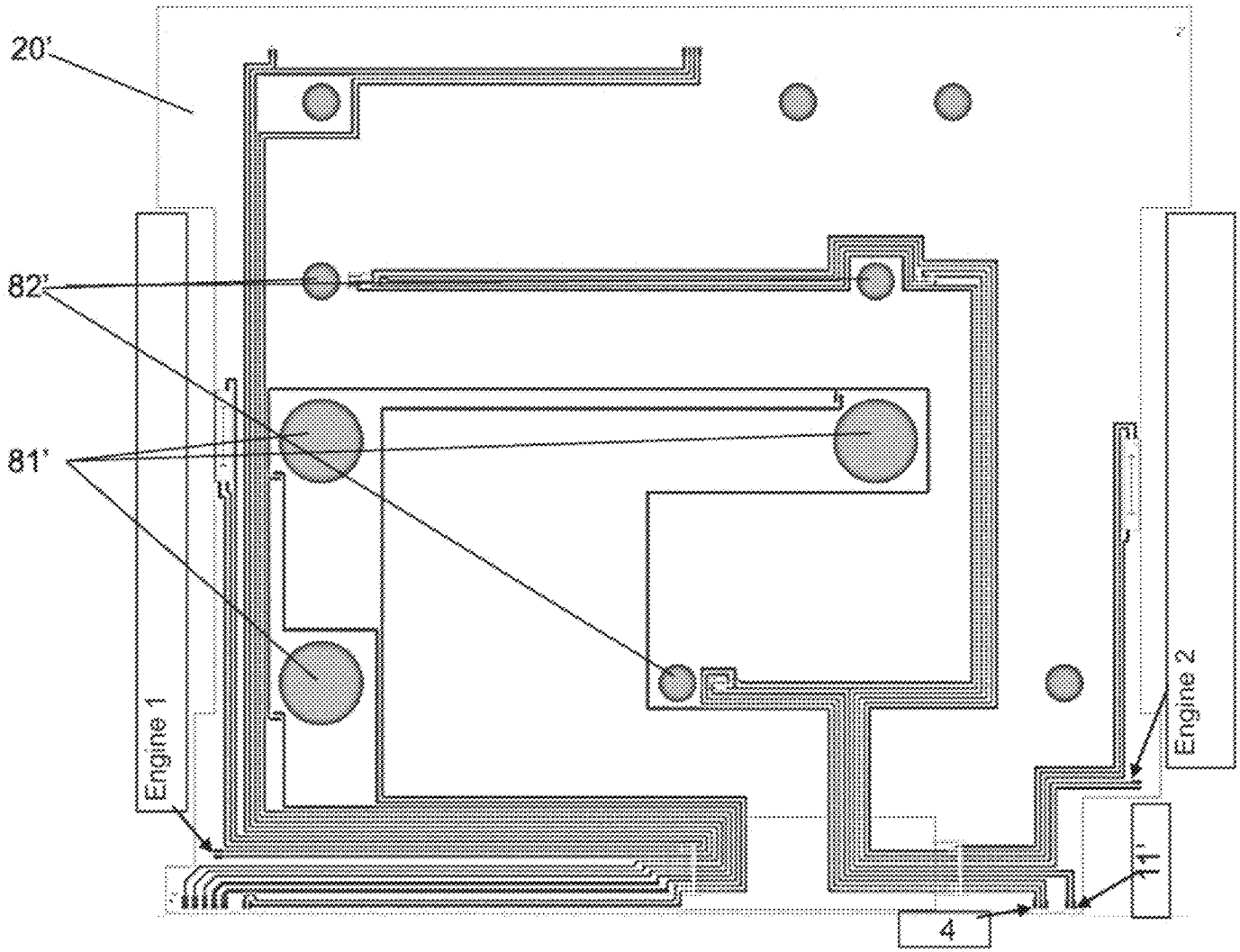
FIG. 4 is a schematic view of a printed circuit board as part of the cover or a printed circuit board top side with conductor tracks and indicated electrical components.

FIG. 4 shows a semi-schematic view from above of the printed circuit board 20' only, in which the various applied conductor tracks can be seen, and reference is made to the electrical consumers connected thereto. The printed circuit board 20' forms part of the sandwich. The ventilators 81' and the humidity sensors 82', as well as other sensors, are attached to the printed circuit board 20' and are electrically contacted. A simple connection of the components to the printed circuit board 20' and thus to the sandwich-type cover 2 is possible.

Figure 5:
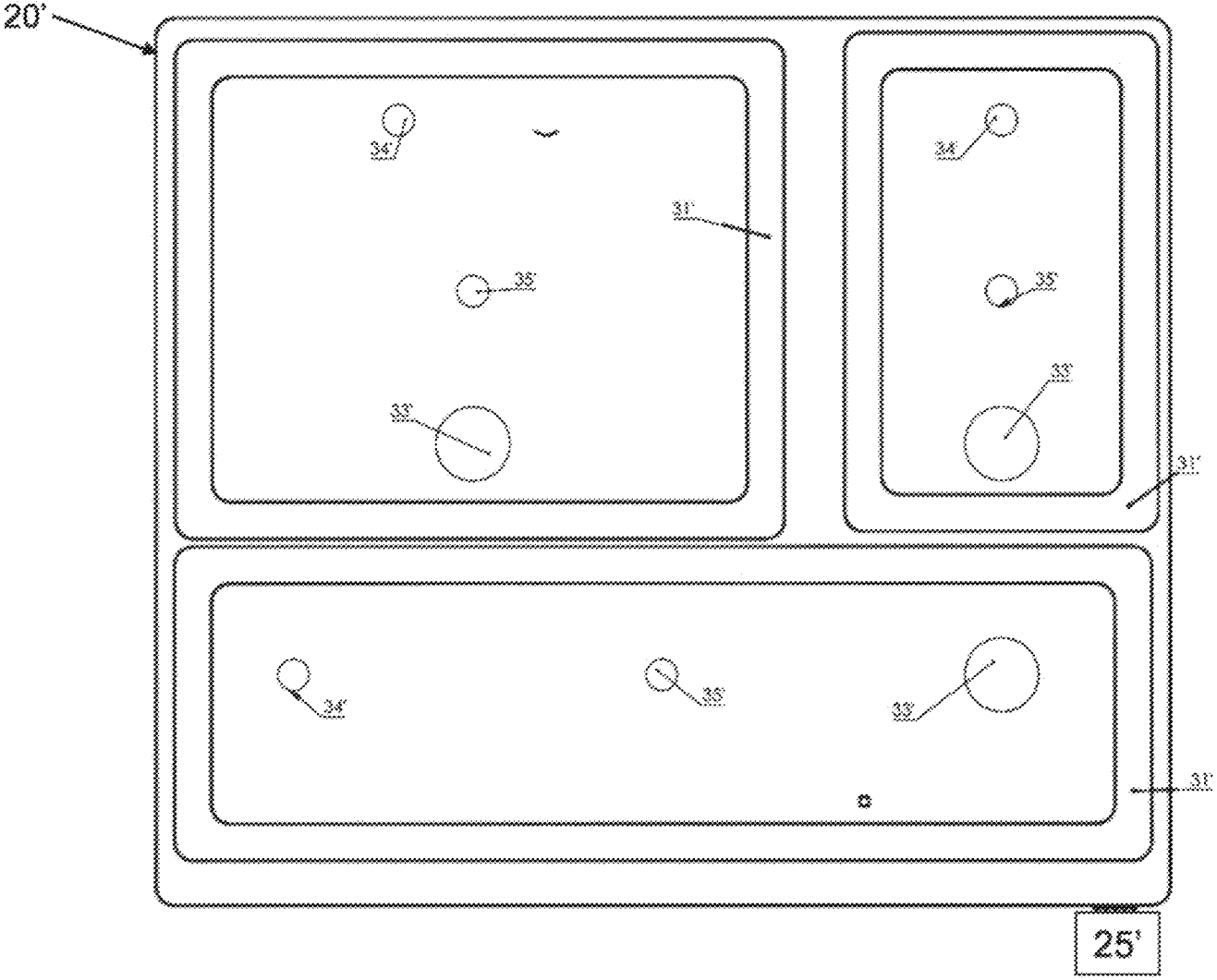

On the drawer interior side, the printed circuit board 20', i.e. here the bottom side of the printed circuit board 20', is shown in FIG. 5. The conductor tracks cannot be seen here as they are arranged on the upper side of the printed circuit board 20'. The connector plug 25' is indicated for orientation and schematically shows the power supply of the printed circuit board 20'. Distributed over the surface are exhaust air openings 33', supply air openings 34', since dehumidification is to be carried out, and openings 35' for humidity sensors 35'. The components are shown in different sections of the printed circuit board 20', which come to rest on different containers 14.

On the bottom side of the printed circuit board 20' or the outer top layer 22", seal holders 32' and a layer of air filter fleece 38' are inserted into the layer of seal profiles 31'. The seal profiles 31' embrace individual sections in which the position of the seal holders 32' can be seen, which cover the air filter fleece 38', and the containers 14 later come to rest under these sections. An exhaust air opening 33' is arranged in each of these sections at the level of the ventilator 81', which is not shown. The opening 35' for the humidity sensor 82' is also arranged in each section. The same applies to the respective air supply opening 34' through which each seal profile 31' or the drawer interior R can be ventilated via the controller.

The sealing element, consisting of seal profiles 31', the seal holder 32' and the layer of air filter fleece 38', are configured to be exchanged (replaceable) and arranged on the cover 2. The sealing element can be entirely removed from the cover 2, for instance for cleaning purposes.

Figure 6:
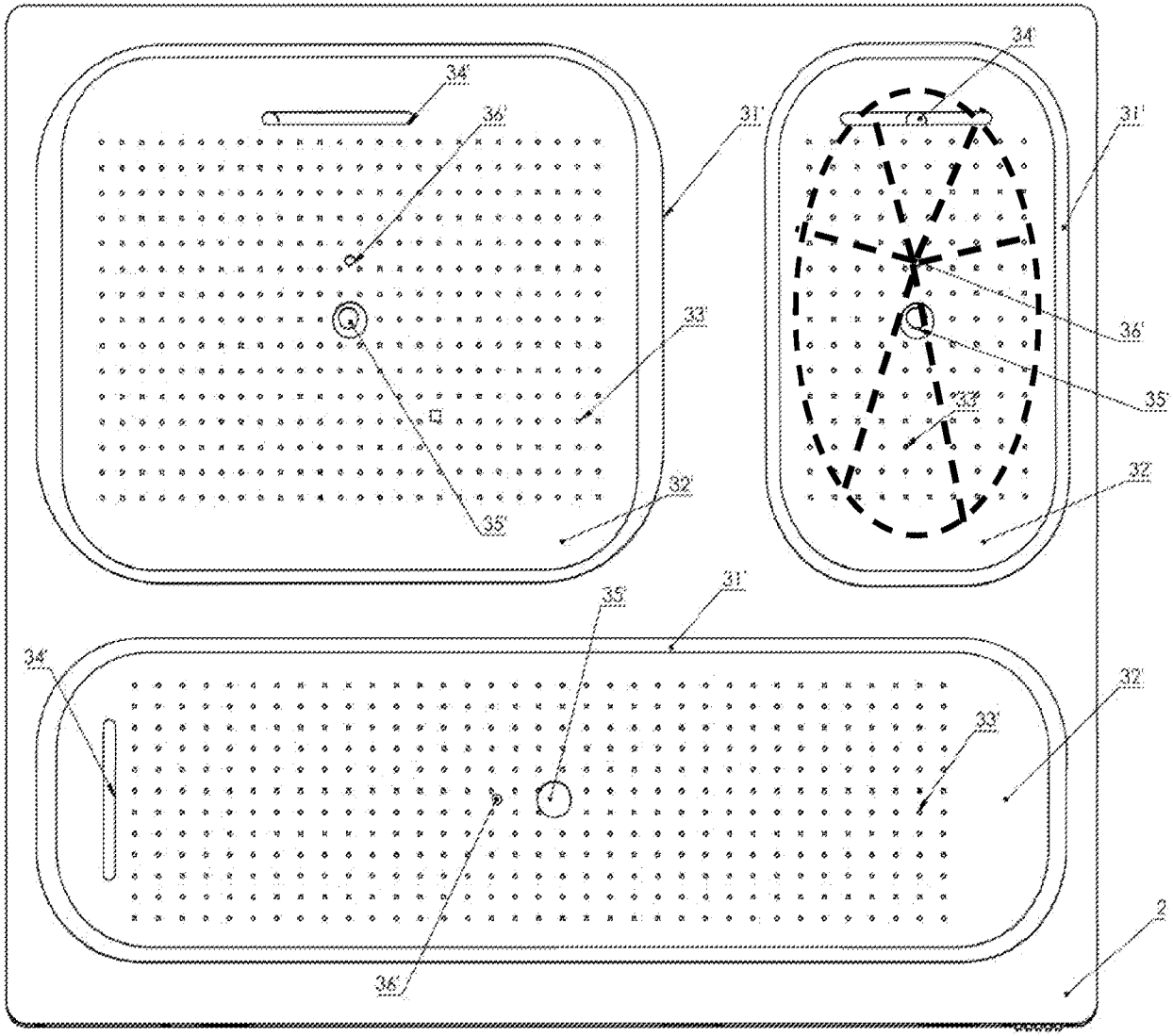
FIG. 6 is a view of the bottom side of the lid or the bottom side of the printed circuit board with completed sealing means and illumination means.

In order to increase the shelf life of the openly stored food in the containers 14 or the drawer interior R, the drawer interior R should be illuminated with blue light in the wavelength range from 450 nm to 470 nm, preferably with 460 nm. For this purpose, at least one appropriate light source 36' per container section is arranged on the printed circuit board 20', the light source 36' being connected to the controller. The light source 36' emits its light through an opening in the sealing means with a maximum possible light cone as surface-covering as possible. The light cone is indicated with dashed lines in FIG. 6.

The invention claimed is:

1. A multi-layer lid having a layered construction to be placed on a drawer of a vacuum drawer system, the lid allowing an evacuation and/or a dehumidification of a drawer interior after sealing to the drawer, the lid comprising:

an outer airtight top layer; and a core layer having recesses formed therein and partially into the outer airtight top layer, the recesses being formed to accommodate an evacuation duct and/or a dehumidification duct, a pump and/or a ventilator, and a sensor, wherein;

the multi-layer lid further comprises a printed circuit board arranged on the outer airtight top layer so as to face the core layer, or the outer airtight top layer is a printed circuit board on which the core layer is located, and electrical components integrated in the lid are mechanically held and electrically connected on the printed circuit board, and wherein the printed circuit board has a plurality of holes arranged therein to allow the drawer interior to be pumped out.

2. The multi-layer lid according to claim 1, further comprising an air exchanger and a sensor inserted in the recesses, and the air exchanger and the sensor are mechanically fixed to the printed circuit board and electrically connected to each other and to a controller.

3. The multi-layer lid according to claim 1, wherein at least a part of a lifting device and/or at least a part of a motor are inserted in the recesses, and are mechanically fixed on the printed circuit board and electrically connected to each other and to a controller.

4. The multi-layer lid according to claim 1, wherein the printed circuit board has a conductor track on a side thereof projecting outwardly from the lid in a direction away from the drawer interior.

5. The multi-layer lid according to claim 1, wherein a layer of seal profiles is arranged in a releasably connected manner on the printed circuit board or on a side of the outer airtight top layer facing the drawer interior.

6. The multi-layer lid according to claim 5, wherein the layer of seal profiles contains a seal holder and a layer of air filter fleece.

7. The multi-layer lid according to claim 1, further comprising a lid frame holding and surrounding individual layers of the layered construction of the multi-layer lid.

8. The multi-layer lid according to claim 1, further comprising a light source mechanically and electrically connected to the printed circuit board so as to radiate towards the drawer interior, the light source emitting light with a wavelength in a range of 450 nm to 470 nm and controlled by a controller.

9. A vacuum drawer system comprising the multi-layer lid according to claim 1.

10. The multi-layer lid according to claim 2, wherein the air exchanger comprises a ventilator and the sensor comprises a humidity sensor.

11. The multi-layer lid according to claim 1, wherein the outer airtight top layer is a lower outer airtight top layer, and the printed circuit board is arranged on an inner side of the lower outer airtight top layer facing away from the drawer interior, and the multi-layer lid further comprising an upper outer airtight top layer, the core layer being arranged between the upper outer airtight top layer and the printed circuit board.

12. A multi-layer lid having a layered construction to be placed on a drawer of a vacuum drawer system, the lid allowing an evacuation and/or a dehumidification of a drawer interior after sealing to the drawer, the lid comprising:

an outer airtight top layer;

a core layer having recesses formed therein and partially into the outer airtight top layer, the recesses being formed to accommodate an evacuation duct and/or a dehumidification duct, a pump and/or a ventilator, and a sensor; and a printed circuit board arranged on the outer airtight top layer so as to face the core layer such that the printed circuit board extends over an entire width and/or extends over an entire length of the outer airtight top layer.

13. The multi-layer lid according to claim 12, wherein a layer of seal profiles is arranged in a releasably connected manner on the printed circuit board or on a side of the outer airtight top layer facing the drawer interior, and the layer of seal profiles contains a seal holder and a layer of air filter fleece.

14. The multi-layer lid according to claim 12, further comprising a light source mechanically and electrically connected to the printed circuit board so as to radiate towards the drawer interior, the light source emitting light with a wavelength in a range of 450 nm to 470 nm and controlled by a controller.

15. The multi-layer lid according to claim 12, wherein the outer airtight top layer is a lower outer airtight top layer, and the printed circuit board is arranged on an inner side of the lower outer airtight top layer facing away from the drawer interior, and the multi-layer lid further comprising an upper outer airtight top layer, the core layer being arranged between the upper outer airtight top layer and the printed circuit board.

16. A multi-layer lid having a layered construction to be placed on a drawer of a vacuum drawer system, the lid allowing an evacuation and/or a dehumidification of a drawer interior after sealing to the drawer, the lid comprising:

a lower outer airtight top layer;

an upper outer airtight top layer;

a core layer having recesses formed therein and partially into the lower outer airtight top layer, the recesses being formed to accommodate an evacuation duct and/or a dehumidification duct, a pump and/or a ventilator, and a sensor, the core layer being arranged between the lower outer airtight top layer and the upper outer airtight top layer; and a printed circuit board arranged on the lower outer airtight top layer so as to face the core layer, the printed circuit board being configured so as to be entirely covered by at least one of the core layer and the upper outer airtight top layer.

17. The multi-layer lid according to claim 16, wherein a layer of seal profiles is arranged in a releasably connected manner on the printed circuit board or on a side of the outer airtight top layer facing the drawer interior, and the layer of seal profiles contains a seal holder and a layer of air filter fleece.

18. The multi-layer lid according to claim 16, further comprising a light source mechanically and electrically connected to the printed circuit board so as to radiate towards the drawer interior, the light source emitting light with a wavelength in a range of 450 nm to 470 nm and controlled by a controller.

* * * * *